United States Patent [19]

Royce

[11] 4,216,808

[45] Aug. 12, 1980

[54] CLAW HAMMER

[76] Inventor: Eric Royce, 122 E. 42nd St., Montclair, N.J. 10017

[21] Appl. No.: 961,973

[22] Filed: Nov. 20, 1978

[51] Int. Cl.[3] ..... B25C 1/00

[52] U.S. Cl. ..... 145/29 R; 254/26 R

[58] Field of Search ..... 145/29 R, 29 B, 29 D, 145/30 R; 254/26 R

[56] References Cited

U.S. PATENT DOCUMENTS

| | | | |
|---|---|---|---|
| 4,155 | 8/1845 | Anderson | 254/26 R |
| D. 140,821 | 4/1945 | MacWithey | 254/26 R |
| 1,287,619 | 12/1918 | Benjamin | 145/29 R |
| 1,565,611 | 12/1925 | Ade | 145/29 R |
| 2,239,719 | 4/1941 | Jarrett | 254/26 R |
| 2,920,869 | 1/1960 | Shelton | 254/26 R |

FOREIGN PATENT DOCUMENTS

| | | | |
|---|---|---|---|
| 1282706 | 12/1961 | France | 145/29 R |
| 8364 | of 1896 | United Kingdom | 254/26 R |

*Primary Examiner*—Nicholas P. Godici
*Assistant Examiner*—J. T. Zatarga
*Attorney, Agent, or Firm*—Anthony H. Handal

[57] ABSTRACT

A hammer having a head with a forward extending nail driving portion, and elongated handle to permit manually gripping and wielding the hammer, and a bifurcated claw portion extending rearwardly from an upper portion of the hammer head for use in the drawing of nails or the like. The claw portion includes a support structure extending from a lower portion of the hammer head to a rearward portion of the claw, to provide support for the tines formed by the bifurcated claw portion. The body of the hammer head may take any usual form, although it is preferably split into upper and lower portions which taper together toward the front of the hammer to support the nail driving portion; and which extend rearwardly to carry the claw structure on the upper portion and the support structure on the lower portion.

The handle may extend through the hammer head to support the upper and the lower portions comprising the hammer head, or may be received in a downwardly opening socket in the hammer head.

2 Claims, 8 Drawing Figures

CLAW HAMMER

BACKGROUND OF THE INVENTION

The present invention relates generally to a tool and, more specifically, pertains to a claw hammer that permits increased withdrawal forces to be applied to nails without damaging the claw portion of the hammer.

Hammers, in one form or another, have been used to accomplish a multitude of different jobs. It is an extremely common tool and, in fact, today, most families own at least one hammer along with one or two screwdrivers and a pair of pliers.

Although there are many different hammer constructions, depending on the use to which the hammer is to be put, by far the most usual hammer owned (and probably the most versatile) is the so-called claw hammer. The claw hammer in its most common form comprises a head with one end adapted for hammering nails or the like and the other end is formed into a bifurcated claw for drawing or removing nails from nail-containing members.

Normally the claw of a claw hammer is curved rearwardly and downwardly to provide good leverage and a rounded pivot or fulcrum for pulling nails out of wood or other materials. The claw is basically in the form of two cantilevered tines, usually with the rearward edges partially sharpened to aid in getting the tines under the head of the nail, to start withdrawing the nail. Unfortunately, this may result in gouging the wood surface. The claw hammer, in one form or another, has been with us in various styles since Roman times. Modern materials have generally improved its performance.

A good claw hammer has a head normally forged from heat-treated steel to improve its ability to withstand rough use. The claw must be quite hard and strong to perform its function without failure. Unfortunately, as the steel becomes harder it becomes more brittle. Because most people normally have only one hammer and this is used indiscriminately for any "hammering" job, the claws are often subject to premature failure due to excessive shocks transmitted to it through the nail-driving end. For example, nail-driving claw hammers have been used for such "hammering" jobs as driving tempered masonry nails or using cold chisels or star drills or the like. The excessive pounding required for these jobs are transmitted to the brittle claw end and have resulted in premature failure of the tines. Of more importance is the fact that simply dropping the hammer has caused the tines to break.

Because of the wide spread popularity of the claw hammer, and its use by persons unfamiliar with the proper handling of a hammer, injuries from the hammer itself have occurred. As noted above, the ends of these tines forming the claw portion are somewhat sharpened. Although a hammer is designed to be held from the far end of the handle, in order to produce maximum leverage and, therefore, maximum force to drive nails, many people carelessly hold the handle at a portion near the hammer head. As can be readily realized, if the hammer strikes a hard surface and bounces back, it will pivot around its handle where the hand grips the handle and possibly cause the sharpened tines to puncture or cut the hand of the user.

As is well known, when drawing nails from wood or other similar materials, a longer lever arm produces a proportionately greater mechanical advantage. As a result, the tines should be as strong as possible so that the force applied to the tines as a result of such mechanical advantage does not shatter the tines when attempting to withdraw a strongly held nail. Strength for the claw tines and long lever arms, according to the prior art construction, required that more and thicker material be used. Practically speaking, this meant that a light weight hammer could not be manufactured with heavy-duty nail-pulling power as failure of the claw tines could easily result. For most practical handy man purposes, a light to moderately heavy hammer, one weighing about a pound, is all that is required and all that most people care to use. Unfortunately, one normally encounters the need for a strong nail pulling hammer even though a light weight hammer is all that is required for driving nails.

Accordingly, an object of the present invention is to provide an improved claw hammer construction.

Another object of this invention is to provide a claw hammer construction wherein the tines of the claw are provided with additional support.

It is a further and related object to provide a hammer which has claw tines with improved strength without requiring a large increase in weight.

It is a further object of this invention to provide a hammer which eliminates the danger of possible self impalement on its claw tines, even if the hammer is misused.

SUMMARY OF THE INVENTION

A hammer, according to the present invention, has a hammer head body portion secured to an elongated handle. A nail-driving portion extends forwardly from the body portion and a bifurcated claw portion having two rearwardly and downwardly extending claw tines extends rearwardly from the body portion.

To provide additional strength to the claw tines, a rearwardly and upwardly extending support structure extends from the lower portion of the hammer head body portion to the tines.

In one embodiment, the support structure is, itself, bifurcated and each part thereof needs the end of a respective tine to form two smooth loops. Since the tines are not cantilevered, one cannot impale oneself on the tines.

To reduce the weight of the hammer, the upper and lower portion of the hammer head body portion are separated and the handle extends through each and individually supports each portion. A modification of the structure incorporates a downwardly open socket in the lower portion to receive the hammer handle. In the second embodiment, the hammer handle does not pass through either upper or lower portion but is rather secured in the socket. To further reduce weight, the upper portion of the socket may have a groove formed therein which opens upwardly into the space between the upper and lower portions.

The handle may be formed as one unit with the hammer head portion, or may be wedged or jammed into openings formed therethrough, with or without a screw passing through the body portion and the handle to further secure it thereto.

BRIEF DESCRIPTION OF THE DRAWINGS

Other features and advantages of the present invention will become more apparent from a consideration of the following detailed description, when taken in conjunction with accompanying drawings, in which.

DESCRIPTION OF THE PREFERRED EMBODIMENTS

Figure 1:
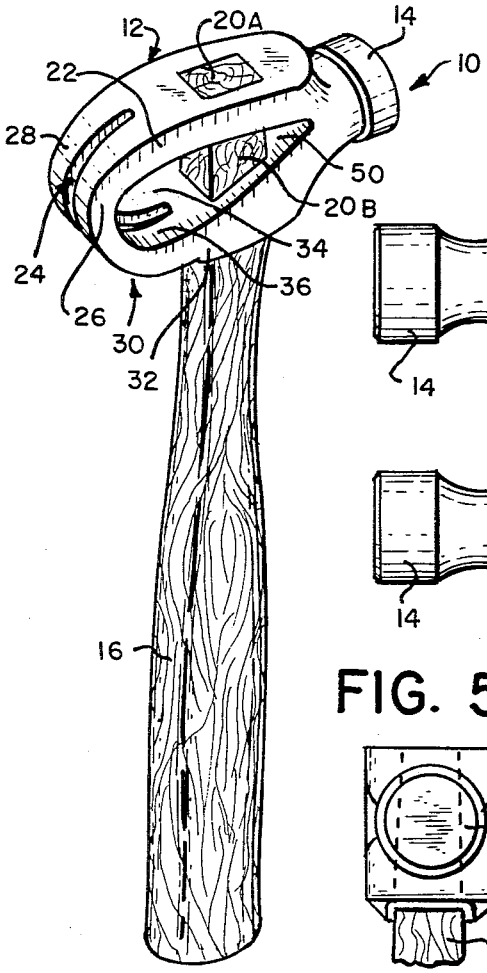
FIG. 1 is a perspective view of a hammer constructed according to the present invention.

A hammer constructed according to the present invention is designated generally by the reference character 10 in FIGS. 1 through 6, and has a hammer head body portion 12 with a forwardly extending nail-driving portion 14.

The body portion 12 is secured to an elongated handle 16 which is adapted to be manually gripped by the user for wielding the hammer. The handle 16 may be made of wood, synthetic plastic materials, or metal, or any other usual material. An elongated fastener such as screw 18 may be used to secure the handle 16 to the body portion 12, or it may be held by friction caused by jamming it into the openings 20A, 20B formed in the body portion 12 for this purpose. Although not shown in the drawings, a wedge, as is usually employed, may be inserted into the top of the handle 16 to further secure it to the body portion 12.

Figure 2:
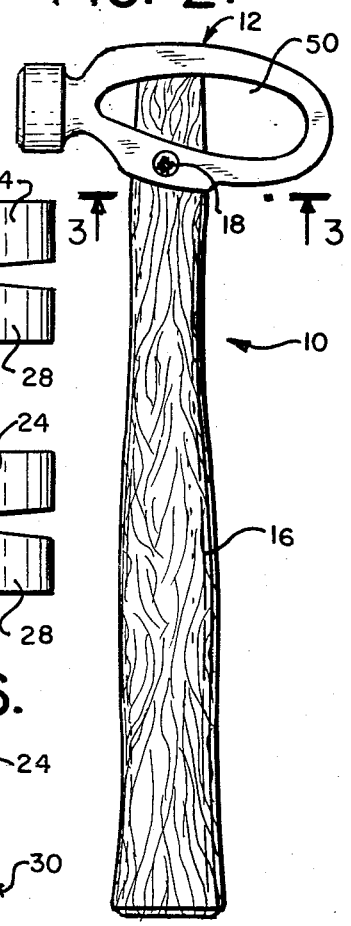
FIG. 2 is a side elevational view of the hammer of FIG. 1.

Extending from an upper portion 22 of the hammer head body portion 12, is a bifurcated claw 24 consisting of tines 26, 28. These tines 26, 28 are adapted for drawing nails or other similar fasteners out of wood, or other materials, in the usual manner in which claw hammers are employed. As can be seen in FIGS. 1 and 2, the tines 26, 28 extend rearwardly and downwardly from the upper portion 22. The tines are further supported by a support structure 30 which extends from a lower portion 32 to the outer end of the tines 26, 28. In the preferred embodiments, the support structure 30 is in the form of two rearwardly and upwardly extending support tines 34, 36 which support respective claw tines 26, 28 and are made integral therewith to provide a unitary structure.

As shown in FIGS. 1 and 2, the upper portion 22 and the lower portion 32 of the hammer head body portion 12 are preferably separated by a forwardly tapering groove 50. This permits control of the weight of the hammer by permitting the use of less material than would otherwise be required for the size of the claw 24 provided on the hammer 10.

Figure 3:
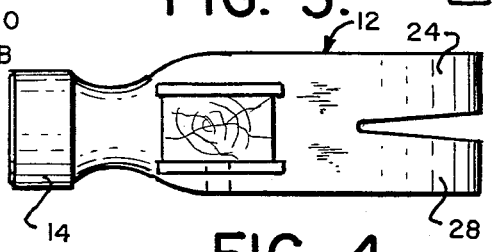
FIG. 3 is a sectional view of the hammer of FIG. 2 taken along lines 3—3.
Figure 4:
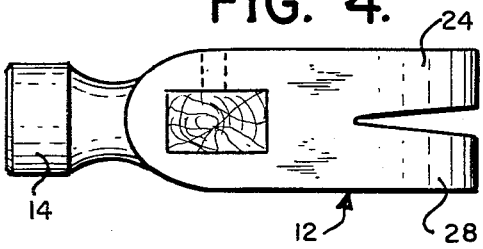
FIG. 4 is a top plan view of the hammer of FIG. 1.
Figure 5:
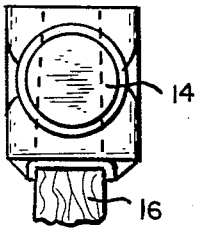
FIG. 5 is a front elevational view of the hammer head portion of FIG. 1.
Figure 6:
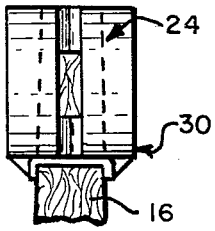
FIG. 6 is a rear elevational view of the hammer head portion of FIG. 1.

In use, the hammer 10 may be used in the conventional manner. That is, for nail-driving purposes, the hammer is wielded in the conventional manner. For nail-driving purposes, the nail head is received between the tines 26, 28 with the head of the nail abutting the interior surface of the tines in the conventional manner. As shown in FIGS. 3 and 4, the opening defined by the tines tapers outwardly rearwardly and converges inwardly toward the top of the head. Thus, the nail head is received in the widest opening and the hammer is moved relative to the nail so that the nail shank abuts the tine edges. Thereafter, the hammer is fulcrummed in the conventional manner to remove the nail from the wood or other nail-retaining material. Since the tines are not cantilevered but fully supported by the support structure 30, the forces on the tines will be fully distributed thereby eliminating the unbalanced forces associated with prior art hammers and the attendant problems noted above.

Accordingly, an improved claw hammer has been described which substantially eliminates injury due to the tines when a hammer rebounds, and also improves the strength of the claw portion without the attendant need for special alloys or treatment procedures.

Figure 7:
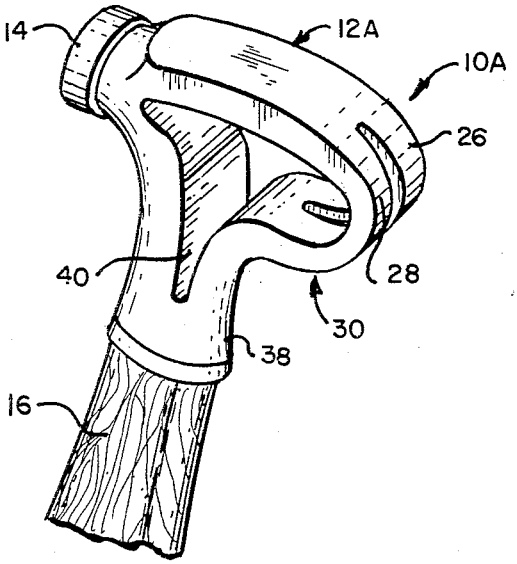
FIG. 7 is a perspective view of a modified embodiment of a hammer constructed according to the present invention.

A modified embodiment of a claw hammer is shown in FIG. 7 and designated generally by the reference character 10A.

The hammer 10A is similar to that shown in FIG. 1 except that, rather than passing through the hammer head body portion, the handle 16 is received in a downwardly open socket 38 formed on the hammer head body portion 12. An upwardly opening tapered slot 40 may be provided in the upper portion of the socket, as shown in FIG. 7, to reduce the weight of the structure required for the downwardly open socket 38.

Figure 8:
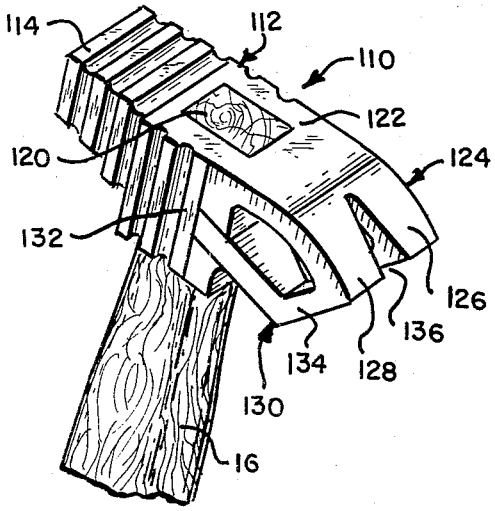
FIG. 8 is a still further modified embodiment of a hammer head according to the present invention.

FIG. 8 illustrates a further modified embodiment 110 of a hammer constructed according to the present invention. Although the appearance of the hammer 110 shown in FIG. 8 is somewhat different than that of the other figures, it operates in basically the same way with the same elements. The hammer head body portion 112 has a forwardly extending nail driving portion 114 and carries, extending from an upper portion 122 thereof, a bifurcated claw 124, composed of claw tines 126, 128.

The claw hammer 110, shown in FIG. 8, was designed for heavier hammers and therefore the hammer head body portion 112 is solid. That is, there is no groove separating the upper portion 122 from its lower portion 132. However, the support structure 130 extends rearwardly and upwardly from the lower portion 132 to support the claw tines 126, 128 with corresponding support tines 134, 136 similar to the hammers 10 and 10A.

While preferred embodiments of the present invention have been shown and described herein it will become obvious that numerous omissions, changes and additions may be made therein without departing from the spirit and scope of the present invention.

What is claimed is:

1. A hammer for driving nails into a workpiece, comprising:

(a) an elongated handle;

(b) a hammer head body portion having an upper portion defining a first handle receiving hole and a lower portion defining a second handle receiving hole aligned with said first hammer receiving hole and having a forwardly extending nail driving portion, one end of said handle passing through said first and second holes, said body portion being secured to said handle near said one end of said handle to permit manual gripping and wielding of said hammer at said other end;

(c) nail drawing means extending rearwardly from and being secured at one end to said upper portion of said body portion, whereby the hammer may be used to remove nails from a workpiece; and (d) support structure integrally secured to and extending from said lower portion of said body portion to the opposite end of said nail drawing means to provide, together with said nail drawing means, a continuous curved structure extending to and from said body portion there being a transverse hollowed-out spaced defined between said upper and lower portions and between said nail driving portion and the nail drawing means and integrally secured support structure such that the spaced upper and lower portions and the spaced nail driving portion and secured nail drawing means and support structure together form a continuous loop which is elongated between the nail driving portion and secured nail drawing means and support structure, an intermediate portion of said one end of said handle extending through the space between said upper and lower portions and between the nail driving means and the secured nail drawing means and support structure and thereby being visible from opposite, transverse sides of said hammer head body portion.

2. A hammer for driving nails into a workpiece comprising:

(a) an elongated handle;

(b) a hammer head body portion having an upper portion and a lower portion, said lower portion defining a handle receiving socket and said upper portion having a forwardly extending nail driving portion, one end of said handle being positioned in said socket and said body portion being secured in said socket near said one end of said handle to permit manual gripping and wielding of said hammer at said other end;

(c) nail drawing means extending rearwardly from and being secured at one end to said upper portion of said body portion, whereby the hammer may be used to remove nails from a workpiece; and (d) support structure integrally secured to and extending from said lower portion of said body portion to the opposite end of said nail drawing means to provide, together with said nail drawing means, a continuous curved structure extending to and from said body portion. there being a transverse, hollowed-out space defined between said upper and lower portions and between said nail driving portion and the nail drawing means and integrally secured support structure such that the spaced upper and lower portions and the spaced nail driving portion and secured nail drawing means and support structure together form a continuous loop which is elongated between the nail driving portion and secured nail drawing means and support structure, the socket being closed at the top such that the handle one end does not extend into the space, and there being an upwardly opening tapered slot extending from the closed end of the socket of the lower portion into the space, the lower portion forming a downwardly extending neck for surrounding the handle end in the socket.

* * * * *